US009751741B2

(12) United States Patent
Schraudolph

(10) Patent No.: US 9,751,741 B2
(45) Date of Patent: Sep. 5, 2017

(54) DISPENSING APPARATUS, METHOD OF DISPENSING, CAPPING APPARATUS AND METHOD OF CAPPING

(71) Applicant: XentiQ Partners Pte Ltd, Singapore (SG)

(72) Inventor: Ulrich Schraudolph, Singapore (SG)

(73) Assignee: XENTIQ PARTNERS PTE LTD, Singapore (SG)

( * ) Notice: Subject to any disclaimer, the term of this patent is extended or adjusted under 35 U.S.C. 154(b) by 549 days.

(21) Appl. No.: 14/339,340

(22) Filed: Jul. 23, 2014

(65) Prior Publication Data

US 2016/0023874 A1 Jan. 28, 2016

(51) Int. Cl.

| | |
|---|---|
| ***B67B 3/20*** | (2006.01) |
| ***B67B 3/06*** | (2006.01) |
| ***B65B 7/28*** | (2006.01) |

(52) U.S. Cl.

CPC ..... *B67B 3/06* (2013.01); *B65B 7/2807* (2013.01); *B67B 3/20* (2013.01); *B65B 7/2835* (2013.01); *B67B 3/2046* (2013.01)

(58) Field of Classification Search

CPC B67B 3/20; B67B 3/2046; B67B 3/06; B65B 7/28; B65B 7/2807; B65B 7/2835

USPC ..... 53/317, 476, 484, 485, 490, 287, 306, 53/309, 310, 331.5, 471; 221/175, 178, 221/156, 191, 194, 195, 196

See application file for complete search history.

(56) References Cited

U.S. PATENT DOCUMENTS

| | | | | |
|---|---|---|---|---|
| 2,440,030 A | | 4/1948 | Thomas | |
| 2,758,434 A | * | 8/1956 | Johnson | B67B 3/2046 221/158 |
| 2,841,939 A | | 7/1958 | Marceau | |
| 2,876,605 A | * | 3/1959 | McElroy | B67B 3/2046 53/315 |
| 3,124,916 A | | 3/1964 | Anderson et al. | |

(Continued)

FOREIGN PATENT DOCUMENTS

| | | |
|---|---|---|
| DE | 894512 B | 10/1953 |
| DE | 2060953 B2 | 6/1972 |

(Continued)

*Primary Examiner* — Gloria R Weeks
*Assistant Examiner* — William A Weller
(74) *Attorney, Agent, or Firm* — Hultquist, PLLC; Steven J. Hultquist

(57) ABSTRACT

A dispensing apparatus including a holding portion for holding a plurality of caps; a retaining device including a gap expandable between a retaining configuration preventing the cap from passing therethrough and a releasing configuration wherein the cap is releasable therethrough; a positioning device configured to receive the cap from the retaining device, the positioning device including an opening expandable between a narrow configuration preventing the cap from passing therethrough and a wide configuration wherein the cap is passable therethrough. The gap of the retaining device is expandable to the releasing configuration when the opening of the positioning device is retracted to the narrow configuration, and the gap of the retaining device is retractable to the retaining configuration when the opening of the positioning device is expanded to the wide configuration. A capping apparatus having such dispensing apparatus, and methods of dispensing a cap, and of capping, are disclosed.

18 Claims, 7 Drawing Sheets

(56) References Cited

U.S. PATENT DOCUMENTS 3,289,383 A * 12/1966 Foss ..... B65B 43/42 53/110
3,365,856 A * 1/1968 Harmon ..... B67B 3/2046 53/318
3,408,788 A * 11/1968 Greck ..... B65B 7/285 53/314
3,460,312 A * 8/1969 Stover ..... B67B 3/2046 53/315
3,977,161 A * 8/1976 Faber ..... B65B 7/2807 193/40
3,986,323 A * 10/1976 Aidlin ..... B65B 7/2807 53/314
4,168,599 A 9/1979 King
4,222,214 A 9/1980 Schultz
4,312,172 A 1/1982 Fisher et al.
4,481,753 A 11/1984 Rutter et al.
4,601,160 A * 7/1986 Heisler ..... B65B 7/2842 193/47
4,608,806 A * 9/1986 Haslam ..... B67B 3/2046 53/314
4,683,706 A * 8/1987 Harper ..... B65B 7/285 53/314
4,691,501 A * 9/1987 King ..... B65B 7/2842 221/222
4,922,684 A * 5/1990 Nelson ..... B65D 41/3409 53/314
5,115,617 A 5/1992 Lewis et al.
5,398,480 A 3/1995 Bankuty
7,131,245 B2 11/2006 Joerg et al.
7,506,781 B2 * 3/2009 Roberts ..... A63B 47/002 221/151
8,381,491 B2 * 2/2013 Yuyama ..... B65B 7/2807 53/281
8,955,292 B2 * 2/2015 Schraudolph ..... B65B 7/2835 53/306
2001/0032437 A1 10/2001 Reinecke

FOREIGN PATENT DOCUMENTS

DE 299369 A7 4/1992
EP 1757555 B1 10/2008
GB 489457 A 7/1938
GB 649328 A 1/1951
WO 9814373 A1 4/1998
WO 2011010963 A1 1/2011

* cited by examiner

DISPENSING APPARATUS, METHOD OF DISPENSING, CAPPING APPARATUS AND METHOD OF CAPPING

TECHNICAL FIELD

The present invention relates to a dispensing apparatus, a method of dispensing, for example, a cap. The present invention further relates to a capping apparatus and a method of capping, for example, a container.

BACKGROUND

Capping of containers, such as bottles, jars, vials and tubs, is typically a fully automated or a manual process. Capping may include application of screw caps onto the containers. Generally, equipment for applying screw caps to containers is automated to screw the caps onto the containers. Sometimes, the equipment may automate the clamping of the container during screwing of the cap.

In conventional fully automated capping machines, all the steps of the capping process may be automated. However, the steps may be achieved by multiple stations performing separate discreet steps or function and does not provide a seamless method of capping containers. For example, the containers may be transported by a transporting system, e.g. a conveyor belt; the screw caps are placed onto the containers at one station; and the caps are screwed onto the container with a fixed chuck or capping wheels in another station. The containers are then moved by the transporting systems between these stations. Such an automated process which includes multiple stations may be costly to build and/or maintain.

For situations where full automation is too costly and large, there is a need for a semi-automation process. For the semi-automation process, the operator is still required to manually take a screw cap and position it on the mouth of the container before the capping can proceed. During the capping, a rotating chuck may be lowered onto the cap and rotate the cap until an end position where the cap can no longer be rotated. The intervention by the operator will limit the productivity of the capping process considerably. Therefore, there is a need to optimize this capping process.

The present invention relates to a dispensing apparatus, a method of dispensing, a capping apparatus and a method of capping, in an attempt to overcome the above disadvantages.

SUMMARY

According to various embodiments, a dispensing apparatus adapted to dispense a cap for capping a container from a plurality of caps is provided. Dispensing apparatus includes a holding portion for holding the plurality of caps; a retaining device including a gap, the gap expandable between a retaining configuration such that the plurality of caps is prevented from passing through the gap thereby retaining the plurality of caps within the holding portion and a releasing configuration wherein the cap is releasable from the holding portion through said gap; a positioning device configured to receive the cap from the retaining device, the positioning device includes an opening, the opening is expandable between a narrow configuration wherein the cap is not passable therethrough and a wide configuration wherein the cap is passable therethrough. The gap of the retaining device is expandable to the releasing configuration to release the cap therethrough when the opening of the positioning device is retracted to the narrow configuration to retain the cap within the positioning device when the positioning device receives the released cap, and the gap of the retaining device is retractable to the retaining configuration to retain the plurality of caps within the holding portion when the opening of the positioning device is expanded to the wide configuration to release and dispense the cap.

According to various embodiments, the positioning device may be movable between a retracted position and a capping position, such that the positioning device may be in the retracted position when the opening is expanded to the wide configuration and the positioning device may be in the capping position when the positioning device is retracted to the narrow configuration.

According to various embodiments, the distance between the gap and the opening may be longer than or equal to the width of the cap but shorter than the width of two caps when the gap is in the releasing configuration and the opening is in the narrow configuration.

According to various embodiments, the retaining device may include a pair of arms, such that the gap is formed between the pair of arms, each arm of the pair of arms being rotatable about a first pivoting point, such that in the retaining configuration, the pair of arms may be rotated towards each other thereby retracting the gap and in the releasing configuration, the pair of arms may be rotated away from each other thereby expanding the gap.

According to various embodiments, each arm of the pair of arms may include a forearm and a rear arm pivotally connected to the forearm, the gap being formed between the forearms of the pair of arms.

According to various embodiments, the rear arm may include a first end and a second end opposite the first end, such that the rear arm may be rotatable at about the first pivoting point at about the first end, the forearm may include a third end and a fourth end opposite the third end, the third end being pivotally connected to the second end, such that the gap may be formed between the fourth ends of the rear arms.

According to various embodiments, the positioning device may include a pair of jaws, such that the opening may be formed between the pair of jaws, each jaw of the pair of jaws being rotatable about a second pivoting point, such that in the narrow configuration, the pair of jaws may rotate towards each other thereby retracting the opening and in the wide configuration, the pair of jaws may rotate away from each other thereby expanding the opening.

According to various embodiments, each jaw of the pair of jaws may include a proximal end and a distal end opposite the proximal end, the jaw being rotatable about the second pivoting point at about the proximal end, such that the opening may be formed between the distal ends of the pair of jaws.

According to various embodiments, each forearm of the pair of arms may be pivotally rotatable at about a third pivoting point between the third end and the fourth end.

According to various embodiments, each jaw of the pair of jaws may include an elongated slot extending along a length of the jaw, such that the rotation of each jaw between the narrow configuration and the wide configuration may be guided by a guiding pin extending into the slot.

According to various embodiments, each forearm of the pair of arms may include a roller rotatably attached to the forearm at about the fourth end of the forearm.

According to various embodiments, each jaw of the pair of jaws may include a roller rotatably attached to the jaw at about the distal end of the jaw.

According to various embodiments, each jaw of the pair of jaws may have an arcuated profile.

According to various embodiments, the first pivoting point of the pair of arms and the second pivoting point of the pair of jaws may coincide with each other.

According to various embodiments, the holding portion may include an elongated channel adapted to arrange the plurality of caps in series.

According to various embodiments, a capping apparatus adapted to cap a container with a cap is provided. The capping apparatus includes a dispensing apparatus according to one of the embodiments above, the dispensing apparatus adapted to dispense the cap; and a rotating device adapted to engage and rotate the cap onto the container.

According to various embodiments, the rotating device may include a pair of wheels, the pair of wheels may include a space between the pair of wheels.

According to various embodiments, the space may be configured to receive the cap between the pair of wheels.

According to various embodiments, a method of dispensing a cap for capping a container from a plurality of caps is provided. The method includes holding a plurality of the caps within a holding portion; expanding a gap of a retaining device to a releasing configuration to release a cap therethrough while retracting an opening of a positioning device to a narrow configuration to retain the cap within the positioning device when the positioning device receives the released cap, such that in the releasing configuration, the cap is releasable through said gap and in the narrow configuration, the cap is not passable through the opening; and retracting the gap of the retaining device to a retaining configuration to retain the plurality of caps within the holding portion while expanding the opening of the positioning device to a wide configuration to release and dispense the cap, such that in the retaining configuration, the plurality of caps is prevented from passing through the gap thereby retaining the plurality of caps within the holding portion, and in the wide configuration, the cap is passable through the opening.

According to various embodiments, the method further includes moving the positioning device between a retracted position and a capping position, such that the positioning device is in the retracted position when the opening is expanded to the wide configuration and in the capping position when the positioning device is retracted to the narrow configuration.

According to various embodiments, a method of capping a container with a cap is provided. The method includes dispensing a cap according to various embodiments; and rotating the cap onto the container.

The capping apparatus is capable of feeding, applying and screwing the caps onto the containers in one integrated mechanism, thereby reducing time and cost in capping containers. In addition, the present invention and size, while increasing flexibility. The capping device here described automates also the feeding of the caps as an integrated part of the capping process.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments are described with reference to the following drawings, in which.

DETAILED DESCRIPTION

Embodiments described below in context of the devices are analogously valid for the respective methods, and vice versa. Furthermore, it will be understood that the embodiments described below may be combined, for example, a part of one embodiment may be combined with a part of another embodiment.

Figure 1A:
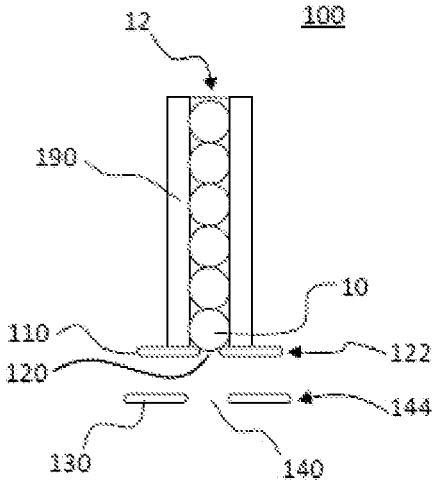
FIG. 1A shows a top view of a dispensing apparatus in a retracted position.

FIG. 1A shows a dispensing apparatus 100 adapted to dispense a cap 10 for capping a container 20 (not shown in FIG. 1A) from a plurality of caps 12. The dispensing apparatus 10 includes a holding portion 190 for holding the plurality of caps 12. The dispensing apparatus 100 includes a retaining device 110 having a gap 120 expandable between a retaining configuration 122 such that the plurality of caps 12 is prevented from passing through the gap 120 thereby retaining the plurality of caps 12 within the holding portion 190 and a releasing configuration 124 (refer to FIG. 1B) such that the cap 10 is releasable from the holding portion 190 through said gap 120. Dispensing apparatus 100 has a positioning device 130 configured to receive the cap 10 from the retaining device 110. The positioning device 130 includes an opening 140, the opening 140 expandable between a narrow configuration 142 (refer to FIG. 1B) such that the cap 10 is not passable therethrough and a wide configuration 144 (refer to FIG. 1A) wherein the cap 10 is passable therethrough.

Figure 1B:
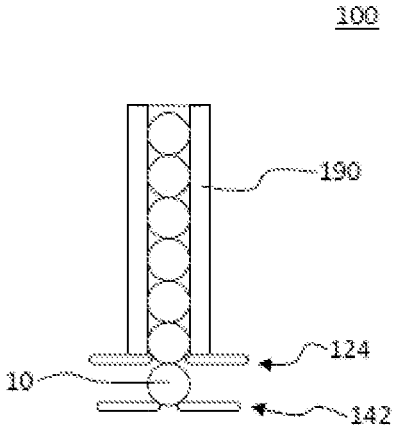
FIG. 1B shows a top view of the dispensing apparatus in FIG. 1A in a capping position.

As shown in FIG. 1B, the gap 120 of the retaining device 110 is expandable to the releasing configuration 124 to release the cap 10 therethrough when the opening 140 of the positioning device 130 is retracted to the narrow configuration 142 to retain the cap 10 within the positioning device 130 when the positioning device 130 receives the released cap 10.

As shown in FIG. 1A, the gap 120 of the retaining device 110 is retractable to the retaining configuration 122 to retain the plurality of caps 12 within the holding portion 190 when the opening 140 of the positioning device 130 is expanded to the wide configuration 144 to release and dispense the cap 10.

Figure 2:
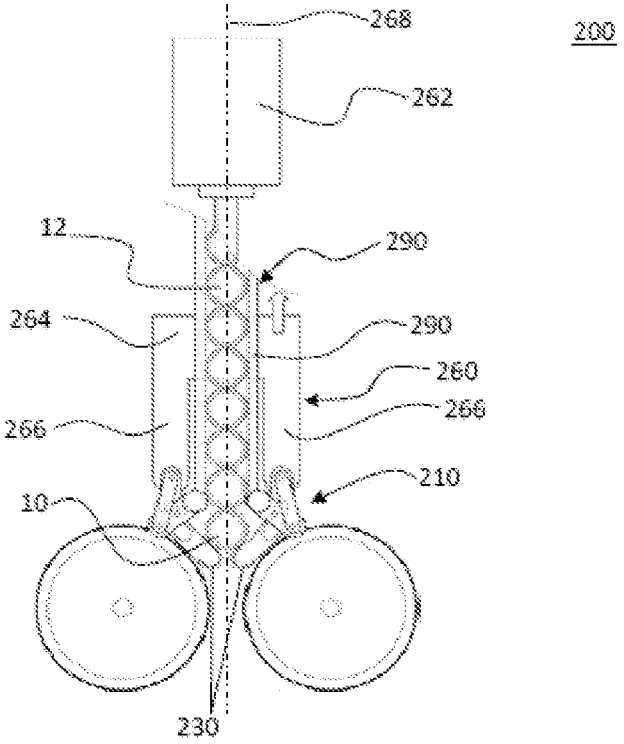
FIG. 2 shows a top view of another embodiment of the dispensing apparatus.

FIG. 2 shows another exemplary embodiment of the dispensing apparatus 200. Dispensing apparatus 200 includes a holding portion 290 adapted to hold a plurality of caps 12. Dispensing apparatus 200 includes a retaining device 210 adapted to retain the plurality of caps 12 within the holding portion 290. Dispensing apparatus 200 includes a positioning device 230 adapted to receive a cap 10 from the retaining device 210. Dispensing apparatus 200 may include an actuating device 260 adapted to actuate the retaining device 210 and/or the positioning device 230. A portion of the holding portion 290 has been removed in FIG. 2 to show an actuator 262.

Figure 3A:
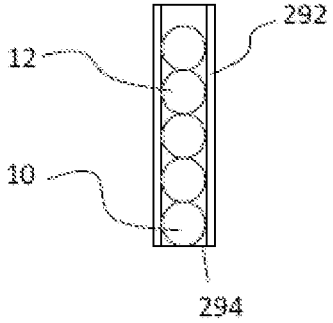
FIG. 3A shows a top view of a holding portion of the dispensing apparatus in FIG. 2.
Figure 3B:
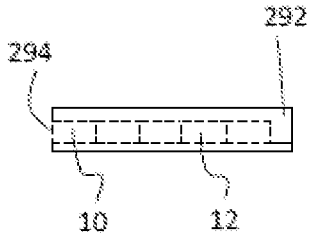
FIG. 3B shows a side view of the holding portion in FIG. 3A in a horizontal position.
Figure 3C:
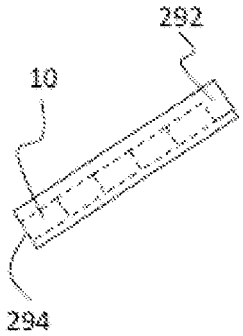
FIG. 3C shows a side view of the holding portion in FIG. 3A in an inclined position.

As shown in FIG. 3A, holding portion 290 may include an elongated channel 292 adapted to arrange the plurality of caps 12 in series. Channel 292 may be adapted to channel the plurality of caps 12 towards the retaining device 110 (not shown in FIG. 3A). Channel 292 may include a mouth 294 where the cap 10 exits the holding portion 290. As shown in FIG. 3B, channel 292 may be horizontal with respect to the ground when viewed from one side. As shown in FIG. 3C, the channel 292 may be inclined with respect to the ground to allow the cap 10 to slide towards the mouth 294 under gravity influence. Holding portion 290 may be spherical or hemispherical or of any shape as long as the holding portion 290 is capable of holding the plurality of caps 12.

Figure 4:
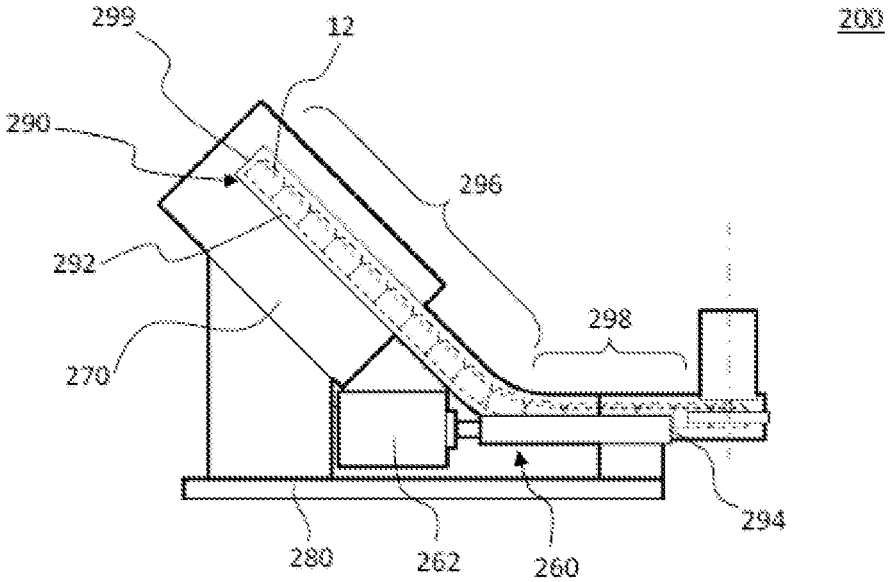
FIG. 4 shows a side view of the dispensing apparatus in FIG. 2.

Referring to FIG. 4, channel 292 may include an elevated portion 296 and a lower portion 298 such that the plurality of caps 12 may be moved from the elevated portion 296 towards lower portion 298. Elevated portion 296 may be inclined to allow the plurality of caps 12 to slide towards the lower portion 298 and towards the mouth 294. The weight of the plurality of caps 12 along the elevated portion 296 may be used to push the plurality of caps 12 along the lower portion 298. Elevated portion 296 and lower portion 298 may be linear channels such that the elevated portion 296 forms an obtuse angle with the lower portion 298. Elevated portion 296 and lower portion 298 may form a continuous elongated channel when viewed from the top of the holding portion 290. Holding portion 290 may include a sensor (not shown in FIG. 4) to detect the quantity of the plurality of caps 12 so that more caps 12 can be fed into the holding portion 290 when the number of caps 12 fall below a pre-determined level. In the event that the number of caps 12 is below the pre-determined level, the dispensing apparatus 200 and/or the capping process may be stopped.

As shown in FIG. 4, dispensing apparatus 200 may include a feeder 270 adapted to feed the plurality of caps 12 into the holding portion 290. Holding portion 290 may be connected to the feeder 270. Feeder 270 may feed the plurality of caps 12 into an inlet 299 of the holding portion 290. Inlet 299 may be at one end of the elevated portion 296. Plurality of caps 12 may slide down towards the lower portion 298 and pushes the cap 10 at the mouth 294 out of the holding portion 290 and towards the retaining device 210 (not shown in FIG. 4). Dispensing apparatus 200 may be mounted on a base plate 280. Base plate 280 may be mounted at a height suitable and ergonomical to an operator to operate the apparatus. Feeder 270 may include a rotational feeder or a vibratory bowl feeder.

Figure 5:
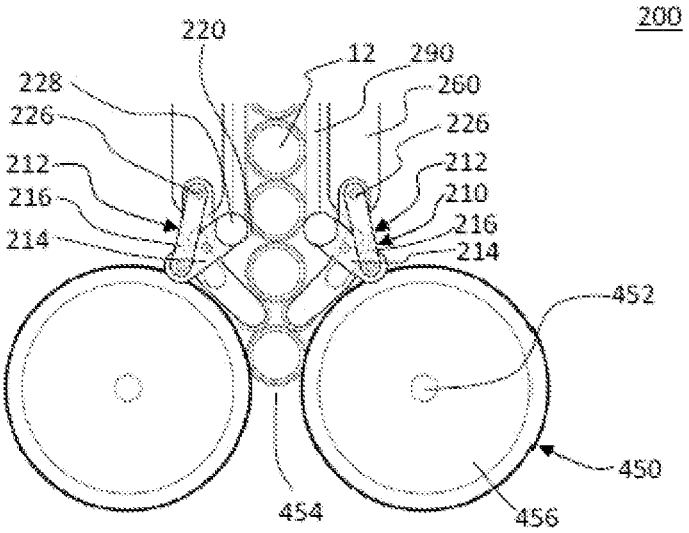
FIG. 5 shows a close-up top view of the dispensing apparatus in FIG. 2.

Referring to FIG. 5, the retaining device 210 may include a gap 220 which is expandable between a retaining configuration such that the plurality of caps 12 may be prevented from passing through the gap 220 thereby retaining the plurality of caps 12 within the holding portion 290 and a releasing configuration wherein the cap 10 may be releasable from the holding portion 290 through said gap 220. Retaining device 210 may include a pair of arms 212, such that the gap 220 may be formed between the pair of arms 212, each arm of the pair of arms 212 being rotatable about a first pivoting point 226. In the retaining configuration, the pair of arms 212 may be rotated towards each other thereby retracting the gap 220 and in the releasing configuration, the pair of arms 212 may be rotated away from each other thereby expanding the gap 220. Each of the pair of arms 212 may be a single arm which does not have joints such that the rotation of the pair of 212 arms towards or away from each other contracts or expands the gap 220. Retaining device 210 may include a pair of gates (not shown in FIG. 5) such that the gap 220 may be formed between the pair of gates. Pair of gates may part or come together to expand or contract the gap 220 respectively.

Figure 6:
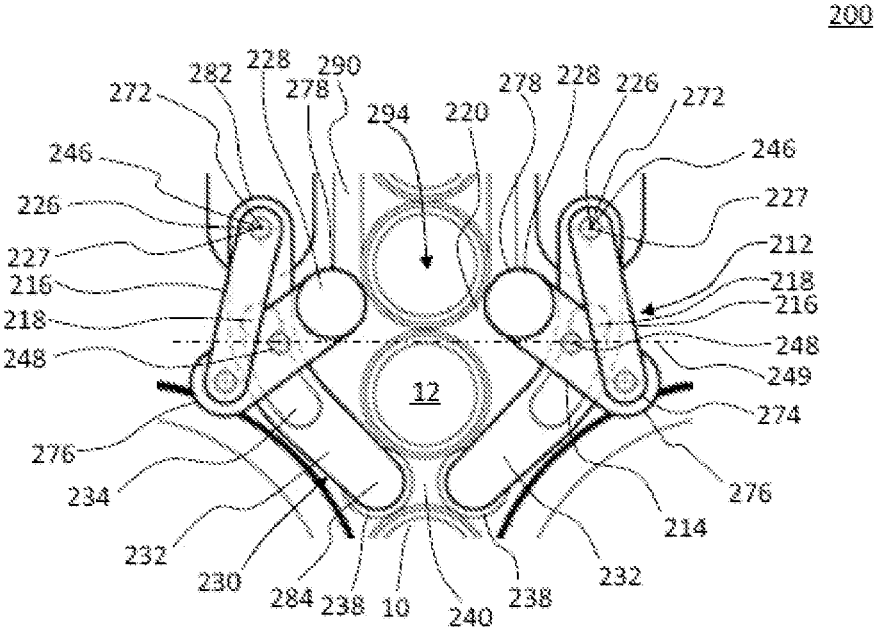
FIG. 6 shows a close-up top view of the dispensing apparatus in FIG. 2.

Referring to FIG. 6, each arm of the pair of arms 212 may include a forearm 214 and a rear arm 216 pivotally connected to the forearm 214 such that the gap 220 may be formed between the forearms 214 of the pair of arms 212. Rear arm 216 may have a first end 272 and a second end 274 opposite the first end 272. Rear arm 216 may be rotatable at about the corresponding first pivoting point 226 at about the first end 272. Forearm 214 may have a third end 276 and a fourth end 278 opposite the third end 276. Third end 276 may be pivotally connected to the second end 274. Gap 220 may be formed between the fourth ends 278 of the forearms 214. Fourth ends 278 may be disposed at about the mouth 294 of the holding portion 290 so as to control the release of the plurality of caps 12 from the mouth 294 of the holding portion 290.

Referring to FIG. 6, the rear arms 216 of the pair of arms 212 may be rotatable about the first pivoting point 226 and the forearm 214 of the pair of arms 212 may be pivotally rotatable at about a third pivoting point 248 between the third end 276 and the fourth end 278. Each forearm 214 may be pivotally connected to a base (not shown in FIG. 6) at the third pivoting point 248. Third pivoting point 248 may be between the third end 276 and the fourth end 278 of each forearm 214.

Referring to FIG. 6, the positioning device 230 may include an opening 240 which is expandable between a narrow configuration 242 (shown later in FIG. 7A) such that the cap 10 is not passable therethrough and a wide configuration 244 such that the cap 10 is passable therethrough. Positioning device 230 may include a pair of jaws 232, such that the opening 240 may be formed between the pair of jaws 232. Each jaw of the pair of jaws 232 may be rotatable about a second pivoting point 246. In the narrow configuration 242 (shown later in FIG. 7A), the pair of jaws 232 may be rotated towards each other thereby retracting the opening 240 and in the wide configuration 244, the pair of jaws 232 may be rotated away from each other thereby expanding the opening 240. Each of the pair of jaws 232 may be single jaw without joints or jaws with at least one joint. Positioning device 230 may include a pair of gates (not shown in FIG. 6) such that the opening 240 may be formed between the pair of gates. Pair of gates may part or come together to expand or retract the opening 240.

Each jaw of the pair of jaws 232 may have a proximal end 282 and a distal end 284 opposite the proximal end 282. Each jaw of the pair of jaws 232 may be rotatable about the corresponding second pivoting point 246 at about the proximal end 282, such that the opening 240 may be formed between the distal ends 284 of the pair of jaws 240. Distal ends 284 may be spaced from the fourth ends 278 of the retaining device 210 such that the gap 220 is spaced from the opening 240. The distance between the gap 220 and the opening 240 may be longer than or equal to the width or diameter of the cap 10 but shorter than the width or diameter of two caps (place side by side) when the gap 220 is in the releasing configuration and the opening 240 is in the narrow configuration 242. Mouth 294 of the holding portion 290, the gap 220 of the retaining device 210 and the opening 240 of the positioning device 230 may be aligned in a substantially linear direction such that the cap 10 may pass through the mouth 294, the gap 220 and the opening 240 linearly.

It can be appreciated that second pivoting point 246 of the pair of jaws 232 may be adjusted to accommodate caps of different diameters. For example, the second pivoting points 246 of the pair of jaws 232 may be shifted away from each other thereby widening the opening 240 to accommodate a cap of larger diameter and vice versa.

As shown in FIG. 6, the first pivoting point 226 of the pair of arms 212 and the pivoting points 246 of the pair of jaws 232 may coincide with each other correspondingly. First pivoting point 226 of the retaining device 210 and the second pivoting point 246 of the positioning device 230 may be along the same axis of rotation 227 such that pair of arms 212 and the pair of jaws 232 may rotate at about the same axis 227. Referring to FIG. 6, the first end 272 of the rear arms 216 may coincide with the proximal end 282 of the pair of jaws 232.

Each forearm 214 of the pair of arms 212 may have a roller 228 rotatably attached to the forearm 214 at about the fourth end 278 of the forearm 214. Gap 220 may be formed between the rollers 228 at about the fourth ends 278 of the pair of forearms. Roller 228 may be in contact with the cap 10 when the cap 10 is retained by the pair of arms 212. Roller 228 may facilitate the cap 10 to pass through the gap 220 by reducing the friction between the fourth end 278 and the cap 10. Each jaw of the pair of jaws 232 may include a roller 238 rotatably attached to the jaw 232 at about the distal end 284 of the jaw 232. Opening 240 may be formed between the rollers 238 at about the distal ends 284 of the pair of jaws 232. Roller 238 may be in contact with the cap 10 when the cap 10 is retained by the pair of jaws 232. Roller 228 may facilitate the cap 10 to pass through the opening 240 by reducing the friction between the distal ends 284 and the cap 10.

Dispensing apparatus 200 may include a power supply (not shown in FIG. 6) adapted to supply power to the actuator 262. Dispensing apparatus 200 may include an electronic controller (not shown in FIG. 6) adapted to control the operation of the dispensing apparatus 200.

Figures 7A, 7B, 7C:
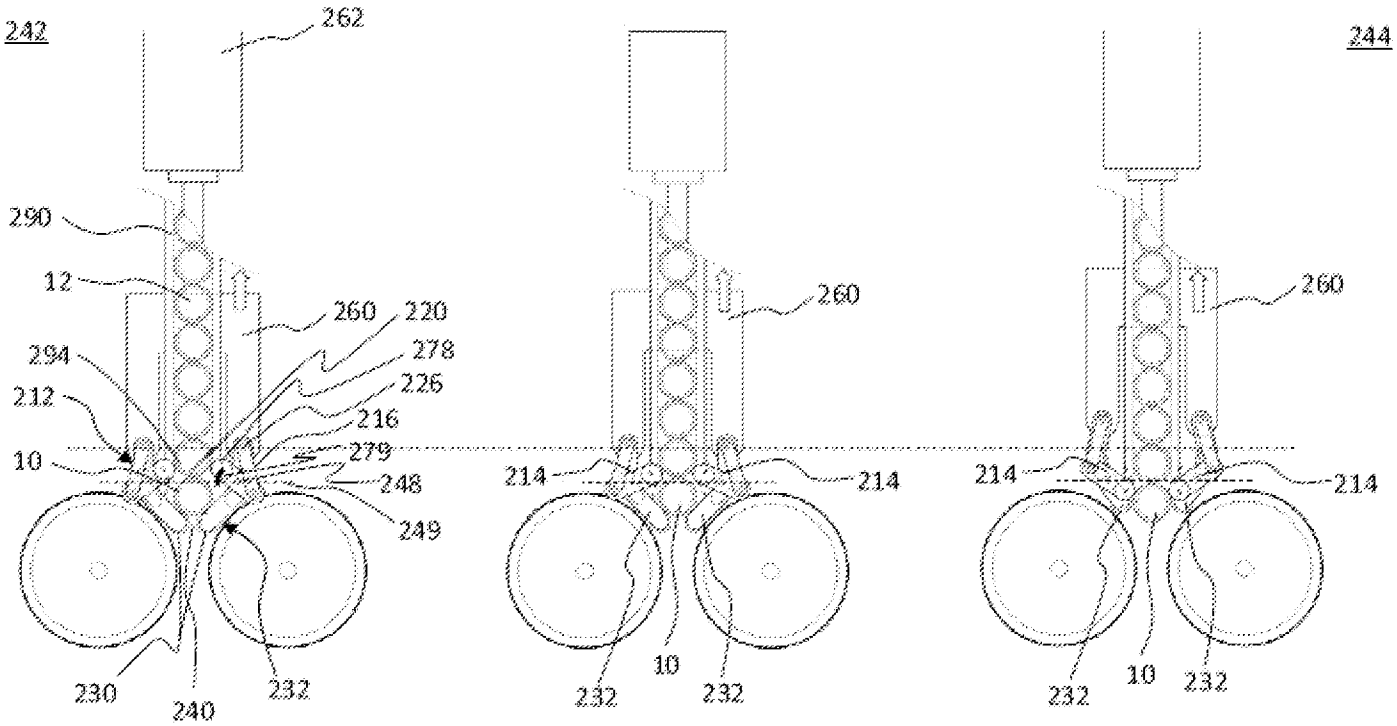
FIG. 7A-7E shows various top views of the dispensing apparatus of FIG. 2 between a retracted position and capping position.
Figures 7D, 7E:
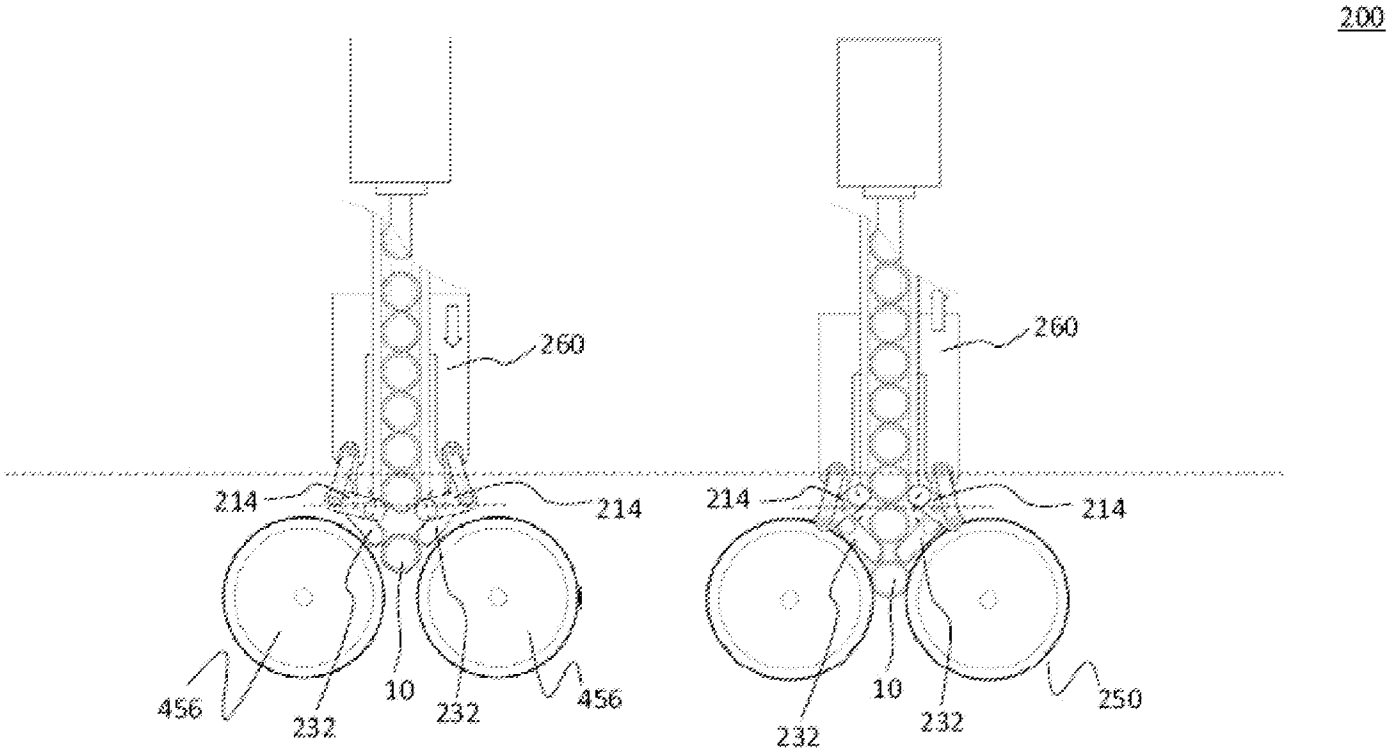

As shown in FIG. 7A to FIG. 7C, the opening 240 may be moved towards the mouth 294 when moving from a capping position (where no cap is shown in the capping space) (as shown in FIG. 7A) to a retracted position (as shown in FIG. 7C) and vice versa. A dashed reference line has been drawn through the first pivoting points 226 of retaining device 210 to show original position of the pivoting points 226 at the capping position. As the actuating device 260 moves from the capping position towards the retracted position, the position of the pivoting points 226 may be referred against the reference line to denote the position of the actuating device 260. Gap 220 may be moved away from the mouth 294 when moving from the capping position to the retracted position and vice versa. As shown in FIG. 7C, the retracted position may be a position where the opening 240 is adjacent the gap 220 such that there is minimal or no space between the gap 220 and the opening 240 when viewed from the top of the dispensing apparatus 200. In this position, the gap 220 and the opening 240 may be in the releasing configuration and the wide configuration 244 respectively such that the cap 10 may be releasable from the mouth 294, e.g. pushed by the plurality of caps 12 under influence of gravity. Gap 220 may be marginally narrower than the diameter of the cap 10 so that the plurality of caps 12 may be retained by the pair of arms 212 after the cap 10 passes through the gap 220. As shown in FIG. 7A or 7E, capping position may be a position where the opening 240 is spaced from the gap 220. As shown in FIG. 7E, capping position may also be a position where the cap 10 is positioned by the positioning device 230 to cap the container 20. In the capping position, the opening 240 may be in the narrow configuration to retain the plurality of caps 12 and the gap 220 may be in the wide configuration to release the plurality of caps 12.

Referring to FIG. 7A, as the rear arms 216 of the pair of arms 212 move from the capping position to the retracted position and vice versa, the forearms 214 may be rotated clockwise or anticlockwise correspondingly at about the third pivoting point 248 such that the fourth end 278 moves along an arcuated path 279. A lateral axis 249 may extend through the third pivoting points 248 of both forearms 214 of the pair of arms 212. It can be seen that the distance between the arcuated paths 279 is the shortest when the arcuated paths 279 intersects the lateral axis 249. As the fourth ends 278 move along the arcuated paths 279, the gap 220 formed between the fourth ends 278 may be the narrowest when the fourth ends 278 are along the lateral axis 249. As the forearms 214 rotate away from the lateral axis 249, whether anti-clockwise or clockwise (depending whether the rear arms 216 are moving to or from the retracted position respectively), the gap 220 widens as the fourth ends 278 move away from the lateral axis 249. Correspondingly, the cap 10 would be retained within the holding portion 290 when the gap 220 is narrower than the diameter of the cap 10 and released from the holding portion 290 via the mouth 294 when the gap 220 is wider than the diameter of the cap 10. It can be appreciated that the first pivoting point 226 of the pair of arms 212 and/or the third pivoting point 248 of the forearms 214 may be adjusted to accommodate caps of different diameters. For example, the third pivoting points 248 of the pair of arms 212 may be shifted away from each other thereby widening the gap 220 to accommodate a cap of larger diameter and vice versa.

Positioning device 230 may be movable between the retracted position (refer to FIG. 7C) and the capping position (refer to FIG. 7A or 7E), such that the positioning device 230 may be in the retracted position when the opening 240 is expanded to the wide configuration 244 and the positioning device 230 may be in the capping position when the positioning device 240 is retracted to the narrow configuration 242. Referring to FIG. 6, each jaw of the pair of jaws 232 may include an elongated slot 234 extending along a length of the jaw 232 such that the rotation of each jaw 232 between the narrow configuration 242 and the wide configuration 244 may be guided by a guiding pin 218 extending into the slot 234. Guiding pin 218 may be adapted to slide within the slot 234. Guiding pin 218 may be rigidly attached to a base (refer to FIG. 6). Each jaw of the pair of jaws 232 may have an arcuated profile. Accordingly, the slot 234 may have an arcuated profile. Pair of jaws 232 and the slot 234 may be arcuated away from the mouth 294 of the holding portion 290 as shown in FIG. 6.

Referring to FIG. 7A to 7C, as the pair of jaws 232 moves from the capping position to the retracted position, the pair of jaws 232 may be rotated away from each other such that the distal ends 284 of the pair of jaws 232 widens therefore widening the opening 240. At the same time, the guiding pin 218 slides along the slot 234 from about one end of the slot to the opposite end. As the slot 234 has an arcuated profile, it can be appreciated that as the pair of jaws 232 moves from the capping position to the retracted position, each jaw of the pair of jaws 232 is rotated outwards or away from each other as the slots 234 glide around the fixed guiding pins 218. Accordingly, as the pair of jaws 232 rotates away from each other, the distal ends 284 of the pair of jaws 232 move away from each other thus widening the opening 240. When the opening 240 widens to equal or more than the diameter of the cap 10, the cap 10 may pass through the opening 240 and slides towards the capping position. When the opening 240 contracts to a width narrower than the diameter of the cap 10 as the pair of jaws 232 moves from the retracted position towards the capping position, the cap 10 may be pushed by the pair of jaws 232 to or towards the capping position. Cap 10 may be held in place by the pair of jaws 232.

Referring to FIG. 6, the third pivoting point 248 may be positioned within the slot 234. The pivoting point 248 is stationary relative to the base plate (not shown) and the jaws 232 with their slots 234 glide relative to the third pivoting point 248 as the pair of jaws 232 moves from the capping position to the retracted position or vice versa. Third pivoting point 248 may be disposed adjacent the guiding pin 218. When viewed from the top of the dispensing apparatus 200, the third pivoting point 248 may be disposed out of, along the perimeter or within the cross-sectional area of the guiding pin 218.

As shown in FIGS. 2 and 7, dispensing apparatus 200 may include an actuating device 260 adapted to actuate the retaining device 210 and/or the positioning device 230. Actuating device 260 may move between a forward position (as shown in FIG. 7A) and a rearward position (as shown in FIG. 7C). Forward position may correspond to the capping position. Rearward position may correspond to the retracted position. Actuating device 260 may move in a direction along a longitudinal axis 268. Retaining device 210 and/or positioning device 230 may be pivotally connected to the actuating device 260. First pivoting point 226 of the retaining device 210 and/or the second pivoting point 246 of the positioning device 230 may be disposed on the actuating device 260. As shown in FIG. 2, the actuating device 260 may include a U-shaped element having a base portion 264 and leg portions 266, spaced apart from each other and extending perpendicularly from the base portion 264 thus forming the U-shape. The shape of the actuating device 260 may accommodate the holding portion 290 such that the holding portion 290 may be disposed between the leg portions 266 of the U-shaped element when the actuating device 260 is in the forward position. In the forward position, the elevated portion 296 of the holding portion 290 may be disposed above the base portion 264. Actuating device 260 may also be in other forms, e.g. actuating device 260 may include two separate elements (not shown in FIG. 2) such that each jaw of the pair of jaws 232 and each arm of the pair of arms 212 along the same side of the longitudinal axis 268 may be connected to the respective separate element. Actuating device 260 may include two separate components such that retaining device 210 may be attached to one of the two components and the positioning device 230 may be attached to the other of the two components. Actuating device 260 may include a cam and follower system, a linkage system or any systems that may convert the circular motion of an actuator with circular motion to a linear motion.

Pair of arms 212 and/or pair of jaws 232 may be biased, e.g. by spring loaded elements, to control the timing of the movement of the arms and jaws respectively. A biasing element (not shown in FIG. 2) may be attached to the actuating device 260 and the base.

Actuating device 260 may include an actuator 262 such that the actuator 262 may actuate the actuating device 260 to move between the forward position and the rearward position. Actuator 262 may be one of a motor, a linear motor, pneumatic cylinder, hydraulic cylinder and solenoid motor.

Retaining device 210 and/or the positioning device 230 may be pivotally connected to the actuating device 260. Positioning device 230 and/or retaining device 210 may be connected to the actuator 262.

Referring to FIG. 7A to 7C, in the capping position in as shown in FIG. 7A, the actuating device 260 may be in the forward position such that the gap 220 may be in a substantially releasing configuration and the opening 240 may be in the narrow configuration 242 so that the plurality of caps 12 with the cap 10 may be released through the gap 220 and onto the positioning device 230. As the actuating device 260 moves from the forward position to the rearward position when the actuating device 260 is actuated by the actuator 262 (as shown in FIG. 7B), the gap 220 may begin to be narrowed to retain the plurality of caps 12 within the holding portion 290 as the forearms 214 rotates to be in line with the lateral axis 249. Meanwhile, the opening 240 may begin to widen towards the wide configuration 244. As the actuating device 260 reaches about the retracted position as shown in FIG. 7C, the gap 220 may be widened again as the forearms 214 rotate pass the lateral axis 249. As the forearms 214 rotate, the forearms 214 may aid the release of the cap 10 through the opening 240 by nudging the cap 10 through the opening 240 with the fourth ends 278 of the forearms 214 as the forearms 214 rotate. At the retracted position, the opening 240 may be widened to the wide configuration 242 thereby allowing the cap 10 to pass through the opening 240 thereby releasing the cap 10 from the holding portion 209. Plurality of caps 12 may be retained by the pair of arms 212.

As shown in FIG. 7C, the moment that the actuating device 260 reaches about the rearward position, the actuating device 260 may be returned to the forward position. As the actuating device 260 moves from the rearward position towards the forward position, the retaining device 210 and the positioning device 230 may move from the retracted position towards the capping position. As the retaining device 210 moves from the retracted position towards the capping position, the gap 220 may be reduced again as the forearms 214 rotate towards the lateral axis 249. Plurality of caps 12 may be retained by the forearms 214 as the gap 220 is narrower than the diameter of each of the plurality of caps 12 and prevented from being released from the mouth 294 of the holding portion 290. The rotation of forearms 214 towards the lateral axis 249 may push the plurality of caps 12 backwards into the holding portion 290. Meanwhile, the opening 240 may be narrowed as the opening 240 moves from the retracted position towards the capping position due to the rotation of the pair of jaws 232 towards each other. As the pair of jaws 232 moves towards the capping position and the opening 240 being narrowed, the cap 10 may be pushed towards the capping position if it is not in that position. As shown in FIG. 7D, the cap 10 may be held in a pre-capping position, wherein the cap 10 is not engaged in the capping wheels 456 yet. FIG. 7E shows that the cap 10 may be in the capping position where the cap 10 is held in place by the pair of jaws 232 and a rotating device 250.

Figure 8:
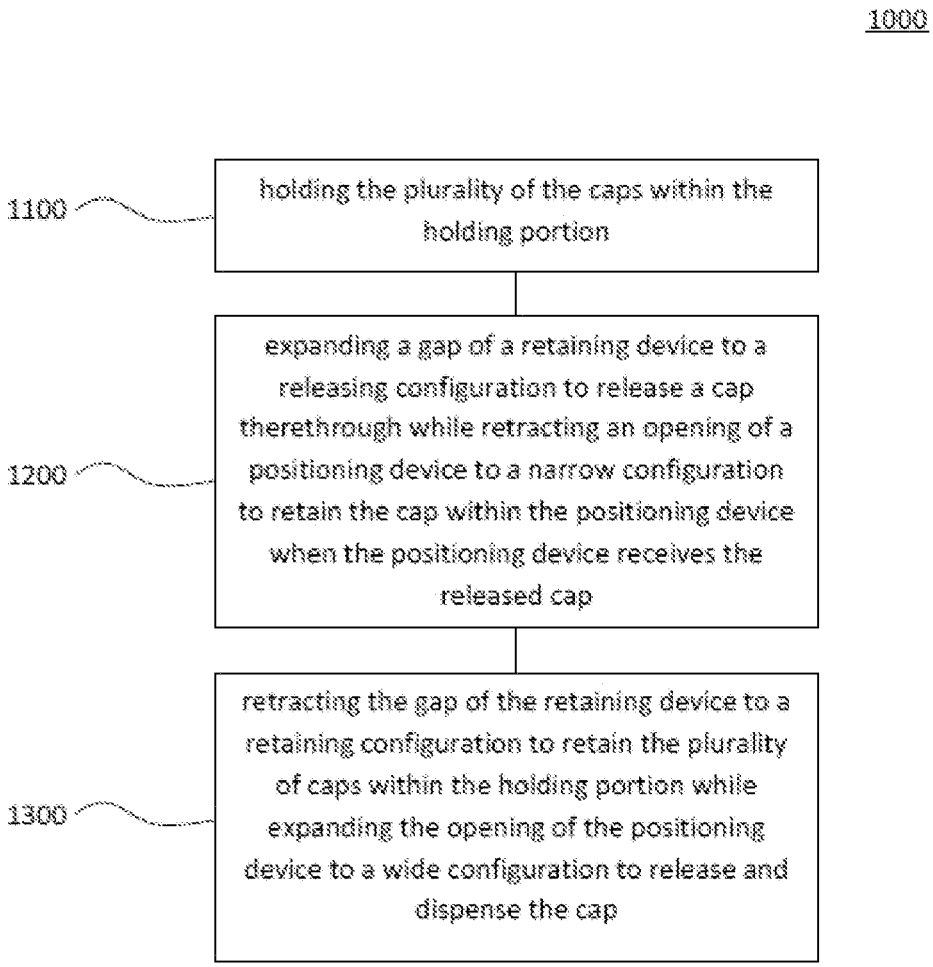
FIG. 8 shows a flow diagram of a method of dispensing a cap from a plurality of caps.

FIG. 8 shows a method 1000 of dispensing the cap 10 for capping a container 20 from a plurality of caps 12. Method 1000 includes a step 1100 of holding the plurality of the caps within the holding portion 190, 290. Step 1200 provides a step for expanding the gap 120, 220 of the retaining device 110, 210 to a releasing configuration 124, 224 to release the cap 10 therethrough while retracting the opening 140, 240 of a positioning device 130, 230 to a narrow configuration 142, 242 to retain the cap 10 within the positioning device 130, 230 when the positioning device 130, 230 receives the released cap 10 such that in the releasing configuration 124, 224, the cap 10 is releasable through said gap 120, 220 and in the narrow configuration 142, 242, the cap 10 is not passable through the opening 140, 240. In step 1300, the gap 120, 220 of the retaining device 110, 210 is retracted to a retaining configuration 122, 222 to retain the plurality of caps 12 within the holding portion 190, 290 while expanding the opening 140, 240 of the positioning device 130, 230 to a wide configuration 144, 244 to release and dispense the cap 10, such that in the retaining configuration 122, 222, the plurality of caps 12 is prevented from passing through the gap 120, 220 thereby retaining the plurality of caps 12 within the holding portion 190, 290, and in the wide configuration 144, 244, the cap 10 is passable through the opening 140, 240.

Referring to FIG. 7A, the dispensing apparatus 200 as shown in FIG. 7A may be in the capping position (but no cap in capping position). Holding portion 290 may hold the plurality of caps 12 therein. In the capping position, the forearms 214 are aligned in a direction towards the mouth 294 of the holding portion 290 such that fourth end 278 may be between the lateral axis 249 and the mouth 294. In this orientation, the fourth end 278 of the forearms 214 is nearer to the holding portion 290 than the lateral axis 249. In this orientation, the gap 220 may be expanded to a releasing configuration and the cap 10 may be released from the holding portion 290. Cap 10 may be released onto the positioning device 230 and retained by the positioning device 230. Cap 10 may be received and retained by the pair of jaws 232 in the narrow configuration 242.

Referring to FIG. 7B, as the actuating device 260 moves from the forward position towards the rearward position, the rear arms 216 of the retaining device 210 may be moved from the capping position towards the retracted position. The movement of the rear arms 216 rotates the forearms 214 in a direction away from the mouth 294. It is understandable that as the forearms 214 starts to rotate, the gap 220 begins to retract. As the forearms 214 rotate towards the lateral axis 249, the gap 220 may contract to the retaining configuration. The forearms 214 may retract to the diameter of the cap and thereafter, smaller than the diameter of the cap 10. As soon as the gap 220 is smaller than the diameter of the cap 10, the cap 10 would be prevented from passing through the gap 220 thereby blocking the cap 10 from being released from the holding portion 290 thus retaining the plurality of caps 12. As the forearms 214 rotate to be in line with the lateral axis 249, the gap 220 formed between the fourth ends 278 may be at about the narrowest between the capping position and the retracted position of the retaining device 210. Meanwhile, the positioning device 230 may move between the retracted position and the capping position, such that the positioning device 230 may be in the retracted position when the opening 240 is expanded to the wide configuration 244 and in the capping position when the positioning device 230 is retracted to the narrow configuration 242. Pair of jaws 232 of the positioning device 230 may be moved from the capping position towards the retracted position and the guiding pin 218 may slide along the slot 234. When in the capping position, the opening 240 of the positioning device 230 may be in the narrow configuration 242. As the positioning device 230 is moving towards the retracted position, the arcuated profile of the slot 234 forces the pair of jaws 232 to rotate away from each other and therefore the distal ends 284 to move away from each other. Accordingly, the opening 240 may expand towards the wide configuration 244 as the positioning device 230 moves from the capping position towards the retracted position.

In FIG. 7C, as the actuating device 260 continues to move from the forward position towards the rearward position, the pair of rearward arms 216 continues to move from the capping position towards the retracted position. Pair of forearms 214 continues to rotate away from the mouth 294 of the holding portion 290. Fourth ends 278 of the pair of forearms 214 may rotate pass the lateral axis 249. Forearms 214, in a direction from the third end 276 towards the fourth end 278, may be pointing in a direction away from mouth 294. In this orientation, the fourth ends 278 having passed the lateral axis 249 may be moving away from each other. Correspondingly, the gap 220 between the fourth ends 278 may be expanding and may be about the diameter of the cap 10 or lesser. Gap 220 may be lesser than the diameter of the cap 10 so that the plurality of caps 12 may be retained within the holding portion 290. Meanwhile, the pair of jaw 232 may be moving to about the retracted position such that the pair of jaws 232 may be in the wide configuration 244, i.e. the opening 240 may be expanding to a dimension equal or larger than the diameter of the cap 10 so that the cap 10 may pass through the opening 240 and the cap 10 may be released from the pair of jaws 232 into a capping position ready to be capped onto a container 20 (not shown in FIG. 7C).

Further, in FIG. 7D, actuating device 260 may be moving from the rearward position towards the forward position. The movement of the pair of arms 212 and the pair of jaws 232 may be moved in the opposite direction from their movement when the actuating device 260 is moving from the forward position towards the rearward position. As the rear arms 216 move towards the capping position, the forearms 214 rotates towards the mouth 294 such that the fourth ends 278 of the forearms 214 move towards the mouth 294. As it can be seen, the gap 220 between the fourth arms 278 begins to contract towards being smaller than the diameter of the cap 10. In this way, the plurality of caps 12 may be retained within the holding portion 290. Meanwhile, the pair of jaws 232 may be moved from the retracted position towards the capping position. Concurrently, the opening 240 between the distal ends 284 of the pair of jaws 232 may contract to smaller than the diameter of the cap 10. As the pair of jaws 232 moves towards the capping position and opening 240 narrows, the cap 10 may be pushed towards the capping position to be used for capping a container 20 (not shown in FIG. 7D). As shown in FIG. 7D, the cap 10 may be separated from the plurality of caps 112 during the movement of the actuating device 260 from the retracted position to the capping position, i.e. forward stroke.

As shown in FIG. 7E, as the actuating device 260 reaches about the forward position where the pair of arms 212 and the pair of jaws 232 are in the capping position, the forearms of the pair of arms 212 may be rotated to about the initial position as described in FIG. 7A and the cap 10 may be again released onto the positioning device 230 when the gap 220 may be wider than and the opening 230 may be narrower than the diameter of the cap 10.

Figure 9:
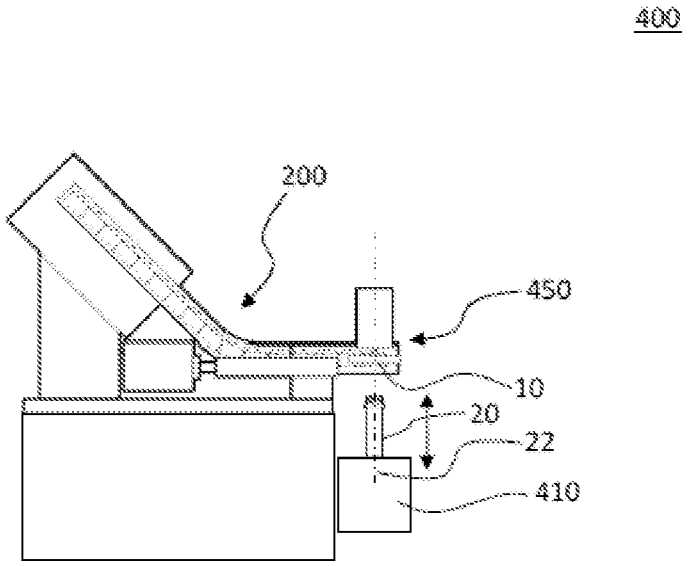
FIG. 9 shows a side view of a capping apparatus.

A capping apparatus 400 is shown in FIG. 9. Capping apparatus 400 may be adapted to cap a container 20 with a cap 10. Capping apparatus 400 may include dispensing apparatus 100,200 and a rotating device 450 adapted to engage and rotate the cap 10 onto the container 20. Rotating device 450 may be adapted to receive the cap 10 and rotate the cap 10 thereby screwing the cap 10 onto the container 20.

As shown in FIG. 5, the rotating device 450 may be at least one wheel 456 rotatable about a rotational axis 452. Rotating device 450 may be a pair of wheels 456, each rotatable about a rotational axis 452. Pair of wheels 456 may include a space 454 between the pair of wheels 456. Space 454 may be configured to receive the cap 10 between the pair of wheels 456. Space 454 may be narrower than the diameter of the cap 10 such that the cap 10 may be retained by the rotating device 450 therebetween such that the cap 10 may not be able to go through the space 454 of the rotating device 450. As shown in FIG. 5, the cap 10 may be positioned between the rotating device 450 and the positioning device 230 in a capping position such that the cap 10 may be capped onto the container 20 at the capping position.

Referring to FIG. 9, capping apparatus 400 may include a container supplying device 410 for supplying the container 20 to the cap 10 at the dispensing apparatus 100. Container supplying device 410 may be disposed about below the rotating device 450 of the dispensing apparatus 200. Container supplying device 410 may be adapted to position the container 20 such that a longitudinal axis 22 of the container 20 may be in line with the centre of the cap 10. Container 20 may have a threaded mouth for engaging the cap 10. When the cap 10 is rotated, the cap 10, which is threaded within, may engage the threaded mouth of the container and lowers onto the container 20 until the cap 10 is tightened onto the container 20. Dispensing apparatus 200 may be moved, e.g. lowered or raised, to move the cap 10 at the capping position to the container 20 so as to cap the container 20 so that the container 20 need not be moved.

Figure 10:
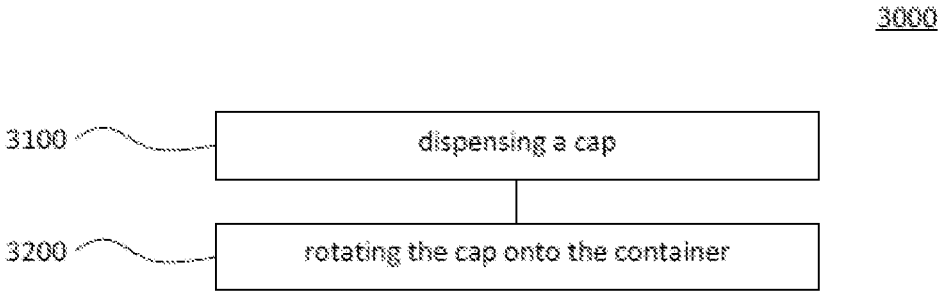
FIG. 10 shows a flow diagram of a method of capping a container.

FIG. 10 shows a method 3000 of capping a container with the cap 10. Method 3000 includes step 3100 of dispensing a cap 20 using the method 2000 described earlier. Step 3200 includes the step of rotating the cap 10 onto the container 20. When the cap 10 is in the capping position, the container 20 may be raised towards the cap 10. Container 20 may be raised to engage the cap 10. Rotating device 450 may be rotated to screw the cap 10 onto the thread of the container 20.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A dispensing apparatus adapted to dispense a cap for capping a container from a plurality of caps, the dispensing apparatus comprising:

a holding portion for holding the plurality of caps;

a retaining device comprising a gap, the gap expandable between a retaining configuration wherein the plurality of caps is prevented from passing through the gap thereby retaining the plurality of caps within the holding portion and a releasing configuration wherein the cap is releasable from the holding portion through said gap, wherein the retaining device comprises a pair of arms, wherein the gap is formed between the pair of arms, each arm of the pair of arms being rotatable about a first pivoting point; and a positioning device configured to receive the cap from the retaining device, the positioning device comprising an opening, the opening expandable between a narrow configuration wherein the cap is not passable therethrough and a wide configuration wherein the cap is passable therethrough, wherein the positioning device comprises a pair of jaws, wherein the opening is formed between the pair of jaws, each jaw of the pair of jaws being rotatable about a second pivoting point;

wherein the first pivoting point of the pair of arms and the second pivoting point of the pair of jaws coincide with each other;

wherein the pair of arms of the retaining device is rotated away from each other to expand the gap of the retaining device to the releasing configuration to release the cap therethrough when the pair of jaws of the positioning device is rotated towards each other to retract the opening of the positioning device to the narrow configuration to retain the cap within the positioning device when the positioning device receives the released cap, and wherein the pair of arms of the retaining device is rotated towards each other to retract the gap of the retaining device to the retaining configuration to retain the plurality of caps within the holding portion when the pair of jaws of the positioning device is rotated away from each other to expand the opening of the positioning device to the wide configuration to release and dispense the cap.

2. The dispensing apparatus of claim 1, wherein the positioning device is movable between a retracted position and a capping position, wherein the positioning device is in the retracted position when the opening is expanded to the wide configuration and the positioning device is in the capping position when the positioning device is retracted to the narrow configuration.

3. The dispensing apparatus of claim 1, wherein the distance between the gap and the opening is longer than or equal to the width of the cap but shorter than the width of two caps when the gap is in the releasing configuration and the opening is in the narrow configuration.

4. The dispensing apparatus of claim 1, wherein each arm of the pair of arms comprises a forearm and a rear arm pivotally connected to the forearm, the gap being formed between the forearms of the pair of arms.

5. The dispensing apparatus of claim 4, wherein the rear arm comprises a first end and a second end opposite the first end, wherein the rear arm is rotatable at about the first pivoting point at about the first end, the forearm comprises a third end and a fourth end opposite the third end, the third end being pivotally connected to the second end, wherein the gap is formed between the fourth ends of the rear arms.

6. The dispensing apparatus of claim 1, wherein each jaw of the pair of jaws comprises a proximal end and a distal end opposite the proximal end, the jaw being rotatable about the second pivoting point at about the proximal end, wherein the opening is formed between the distal ends of the pair of jaws.

7. The dispensing apparatus of claim 5, wherein each forearm of the pair of arms is pivotally rotatable at about a third pivoting point between the third end and the fourth end.

8. The dispensing apparatus of claim 7, wherein each jaw of the pair of jaws comprises an elongated slot extending along a length of the jaw, wherein the rotation of each jaw between the narrow configuration and the wide configuration is guided by a guiding pin extending into the slot.

9. The dispensing apparatus of claim 5, wherein each forearm of the pair of arms comprises a roller rotatably attached to the forearm at about the fourth end of the forearm.

10. The dispensing apparatus of claim 1, wherein each jaw of the pair of jaws comprises a roller rotatably attached to the jaw at about the distal end of the jaw.

11. The dispensing apparatus of claim 1, wherein each jaw of the pair of jaws has an arcuated profile.

12. The dispensing apparatus of claim 1, wherein the holding portion includes an elongated channel adapted to arrange the plurality of caps in series.

13. A capping apparatus adapted to cap a container with a cap, the capping apparatus comprising:

a dispensing apparatus as claimed in claim 1, the dispensing apparatus adapted to dispense the cap; and a rotating device adapted to engage and rotate the cap onto the container.

14. The dispensing apparatus of claim 13, wherein the rotating device comprises a pair of wheels, the pair of wheels comprising a space between the pair of wheels.

15. The dispensing apparatus of claim 14, wherein the space is configured to receive the cap between the pair of wheels.

16. A method of dispensing a cap for capping a container from a plurality of caps, the method comprising:

holding a plurality of the caps within a holding portion;

rotating a pair of arms of a retaining device away from each other about a first pivoting point to expand a gap of the retaining device to a releasing configuration to release a cap therethrough while rotating a pair of jaws of a positioning device towards each other about a second pivoting point to retract an opening of the positioning device to a narrow configuration to retain the cap within the positioning device when the positioning device receives the released cap, wherein in the releasing configuration, the cap is releasable through said gap and wherein in the narrow configuration, the cap is not passable through the opening; and rotating the pair of arms of the retaining device towards each other about the first pivoting point to retract the gap of the retaining device to a retaining configuration to retain the plurality of caps within the holding portion while rotating the pair of jaws of the positioning device away from each other about the second pivoting point to expand the opening of the positioning device to a wide configuration to release and dispense the cap, wherein in the retaining configuration, the plurality of caps is prevented from passing through the gap thereby retaining the plurality of caps within the holding portion, and in the wide configuration, the cap is passable through the opening, wherein the first pivoting point of the pair of arms and the second pivoting point of the pair of jaws coincide with each other.

17. The method of claim 16, further comprising moving the positioning device between a retracted position and a capping position, wherein the positioning device is in the retracted position when the opening is expanded to the wide configuration and in the capping position when the positioning device is retracted to the narrow configuration.

18. A method of capping a container with a cap, the method comprising:

dispensing a cap according to a method as claimed in claim 16; and rotating the cap onto the container.

* * * * *